United States Patent [19]

Ikeoka

[11] 4,417,511

[45] Nov. 29, 1983

[54] MOVING BOLSTER ARRANGEMENT

[75] Inventor: Naoaki Ikeoka, Komatsu, Japan

[73] Assignee: Kabushiki Kaisha Komatsu Seisakusho, Tokyo, Japan

[21] Appl. No.: 386,320

[22] Filed: Jun. 8, 1982

[51] Int. Cl.[3] ..... B30B 15/06

[52] U.S. Cl. ..... 100/229 R; 72/446; 100/918

[58] Field of Search ..... 100/221, 224, 229 R, 100/207, 918; 72/446, 448, 447

[56] References Cited

U.S. PATENT DOCUMENTS

| | | | |
|---|---|---|---|
| 3,230,869 | 1/1966 | Wilkins | 100/229 R X |
| 3,516,277 | 6/1970 | Bracco et al. | 100/918 X |
| 4,152,978 | 5/1979 | Abe et al. | 100/229 R X |

FOREIGN PATENT DOCUMENTS

| | | | |
|---|---|---|---|
| 46-42557 | 12/1971 | Japan | 100/918 |

*Primary Examiner*—Billy J. Wilhite

*Attorney, Agent, or Firm*—Armstrong, Nikaido, Marmelstein & Kubovcik

[57] ABSTRACT

A moving bolster arrangement for a transfer press having three uprights defining a first and a second press station therebetween. The arrangement includes first and second left side moving bolsters and first and second right side moving bolsters, each adapted to move into and out of first and second press stations. Each moving bolster has a motor mounted thereon for driving the same. Motors mounted on the first and second left side moving bolsters are connected to a single power source through electric cables while motors mounted on the first and second right side moving bolsters are connected to another single power source through electric cables.

1 Claim, 1 Drawing Figure

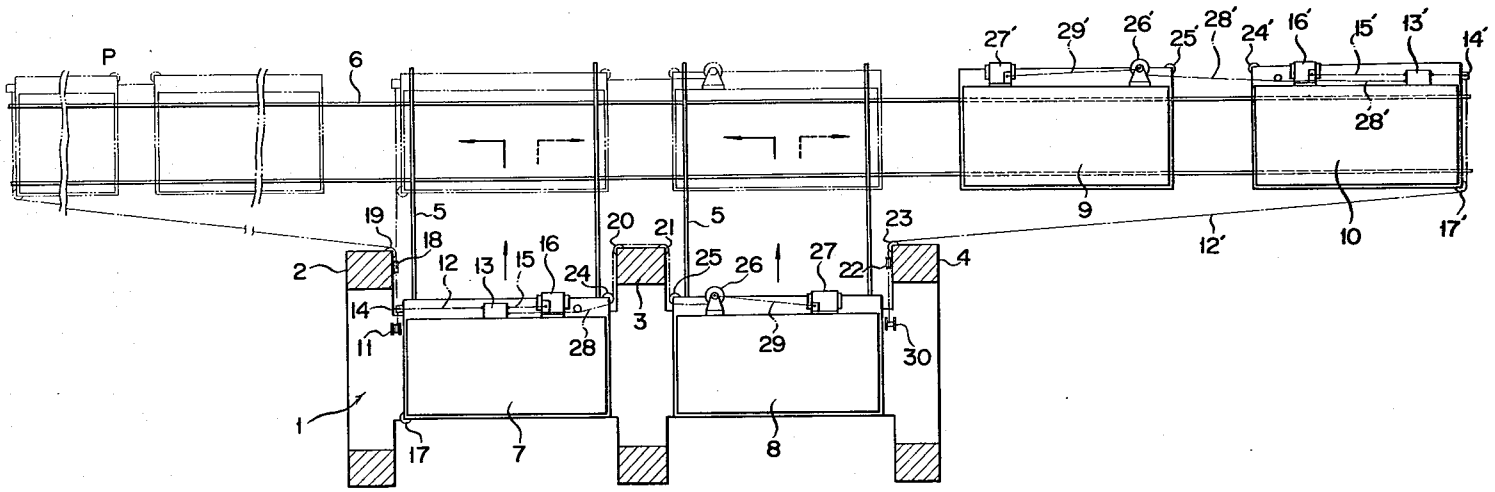
14'
17'
13'
15'
28'
10
16'
24'
28'
12'
25'
26'
29'
9
27'
4
23
30
22
27
29
8
26
5
25
21
3
20
24
28
16
15
7
13
12
5
18
17
19
14
11
6
2
1
P

MOVING BOLSTER ARRANGEMENT

BACKGROUND OF THE INVENTION

This invention relates to a moving bolster arrangement for a three-column type transfer press.

In a conventional moving bolster arrangement of the type specified above, each bolster has an electric cable extending from respective cable reels mounted independently on the bed so that when two sets of left-hand moving bolsters move into the press room while two sets of right-hand moving bolsters are allowed to park outside the press, one of the left-hand moving bolsters cannot move into the press room because the electric cable of one of the right-hand moving bolsters interferes therewith.

Therefore, in the conventional bolster arrangement, the electric cables of one of the right-hand moving bolster and one of the left-hand moving bolster each has disconnectable plug socket thereon, and as occasion demands, the plug sockets are connected or disconnected to enable the advancement of the left-hand and right-hand moving bolsters.

However, such socket connecting and disconnecting operations require much labour and accompany a danger because of handling of electric cables per se, and at the same time, such operations are time-consuming and against the concept of quick die change system.

SUMMARY OF THE INVENTION it is therefore an object of the present invention to provide a moving bolster arrangement which overcomes the above noted problems of the prior art.

Another object of the present invention is to provide a moving bolster arrangement wherein a pair of left side moving bolsters are connected with each other through a single electric cable and also connected to a single power source while a pair of right side moving bolsters are connected with each other and also connected to another single power source, thus enabling a quick bolster change-over between left and right sides moving bolsters to be effected.

In accordance with an aspect of the present invention, there is provided a moving bolster arrangement for a transfer press having a bed and a first, a second and a third upright defining a first and a second press station therebetween, comprising: a first left side moving bolster adapted to be moved into and out of said first press station; a second left side moving bolster adapted to be moved into and out of said second press station; a first right side moving bolster adapted to be moved into and out of said first press station; a second right side moving bolster adapted to be moved into and out of said second press station; a first motor mounted on said first left side moving bolster for driving the same; a second motor mounted on said second left side moving bolster for driving the same; a third motor mounted on said second right side moving bolster for driving the same; a fourth motor mounted on said first right side moving bolster for driving the same; a first controller mounted on said first left side moving bolster; a second controller mounted on said second right side moving bolster; a first cable reel mounted on said bed at a left end portion thereof; a second cable reel mounted on said second left side moving bolster; a third cable reel mounted on said bed at a right end portion thereof; a fourth cable reel mounted on said first right side moving bolster; a first cable winding round said first cable reel and having one end connected to a first power source and the other end connected to said first controller; a second cable interconnecting said first controller and said first motor; a third cable winding round said second cable reel and having one end connected to said first controller and the other end connected to said second motor; a fourth cable winding round said third cable reel and having one end connected to a second power source and the other end connected to said second controller; a fifth cable interconnecting said second controller and said third motor; and a sixth cable winding round said fourth cable reel and having one end connected to said second controller and the other end connected to said fourth motor.

The above and other objects, features and advantages of the present invention will be readily apparent from the following description taken in conjunction with the accompanying drawing.

BRIEF DESCRIPTION OF THE DRAWING

Accompanying drawing is a schematical plan view with partially cross-sectioned of a moving bolster arrangement according to the present invention.

DESCRIPTION OF THE PREFERRED EMBODIMENT

The present invention will now be described in detail by way of example only with reference to the accompanying drawing.

In the drawing, reference numeral 1 denotes a press room, 2, 3 and 4 uprights and 5, 6 rails.

First and second left-hand moving bolsters 7, 8 are arranged to move out from inside the press room 1 through the rails 5 to thereby move on the rails 6 leftwards as shown by solid line arrows and also to move from the parking station into the press room 1 in the reverse manner.

Further, first and second right-hand moving bolsters 9 and 10 are arranged to move out from inside the press room 1 through the rails 5 to thereby move on the rails 6 rightwards as shown by dotted line arrows and also to move from the parking position into the press room 1 in the reverse manner.

Installed on the left side of a bed within the press room 1 is a first cable reel 11, and an electric cable extending through the core of the reel 11 is connected with a power supply (not shown). An electric cable 12 wound round the first cable reel 11 is connected through a connector means 14 with the input side of a control panel 13 mounted on the first left-side moving bolster 7. The output side of the control panel 13 is connected through an electric cable 15 with a first motor 16 arranged to drive the first left-hand moving bolster 7, Further, mounted at the left end of the front part of the first left-hand running bolster 7 is a pulley 17, and installed at the right end of the rear portion of the left-hand upright 2 are pulleys 18 and 19.

Mounted at the left and right ends of the rear portion of the central upright 3 are pulleys 20 and 21, respectively, whilst mounted on the right-hand upright 4 are pulleys 22 and 23.

Pulleys 24 and 25 are mounted at the inside corners of the rear portions of the first and second left-hand moving bolsters 7 and 8.

Mounted on the rear side of the second left-hand moving bolster 8 are a second cable reel 26 and a second motor 27 for driving the bolster 8. An electric cable 28 extending from the other output side of the control panel 13 is wound round the second cable reel 26 through the pulleys 24, 20, 21 and 25. An electric cable 29 connected with the core side of the second cable reel 26 is connected with the second motor 27.

Provided on the right-hand end of the bed of the press room 1 is a third cable reel 30. An electric cable passing through the core side of the third cable reel 30 is connected with another power supply (not shown). An electric cable 12' wound round the third cable reel 30 is connected through the pulleys 22 and 23 mounted on the right-hand upright 4 with the input side of a control panel 13' installed on the second right-hand moving bolster 10. The electric cable 12' is secured by means of a connector 14' on the right-hand end of the rear portion of the second right-hand moving bolster 10. The output side of the control panel 13' is connected by means of an electric cable 15' with a third motor 16' adapted to drive the second right-hand moving bolster 10. The pulley 17' is mounted at the right-hand end of the front portion of the second right-hand moving bolster 10.

Mounted on the rear side of the first right-hand moving bolster 9 are a fourth cable reel 26' and a fourth motor 27' for driving the bolster 9. An electric cable 28' extending from another output side of the aforementioned control panel 13' is wound round the fourth cable reel 26' through pulleys 24' and 25'. Further, an electric cable 29' connected with the core side of the fourth cable reel 26' is connected with the fourth motor 27'.

Thus, when moving from the press room 1 to the parking position P, the first and second left-hand moving bolsters 7 and 8 are moved by means of the first and second drive motors 16 and 27, respectively, on the rails 5 and 6 in the direction shown by solid line arrows. In this case, the electric cable is sent out or unwound from the first cable reel 11 mounted on the left-hand end of the bed by the movement of the first left-hand moving bolster 7. Further, as a result of movement of the second left-hand moving bolster 8, the electric cable 28 is wound round the second cable reel 26 mounted on the bolster 8 so that the latter may move to the parking position P as shown by two-dot chain line.

Further, when moving from the parking position P into the press room 1, the electric cable 12 is wound round the first cable reel 11 and the electric cable 28 is sent out or unwound in the manner reverse to the abovementioned case.

Moreover, when the first and second right-hand moving bolsters 9 and 10 are moved, the third cable reel 30 mounted on the right hand end of the bed and the fourth cable reel 26' mounted on the first right-hand moving bolster 9 enables the electric cables 12' and 28' to be unwound and wound, respectively, in the same manner as the aforementioned case.

What is claimed is:

1. A moving bolster arrangement for a transfer press having a bed and a first, a second and a third upright defining a first and a second press station therebetween, comprising:

a first left side moving bolster adapted to be moved into and out of said first press station;

a second left side moving bolster adapted to be moved into and out of said second press station;

a first right side moving bolster adapted to be moved into and out of said first press station;

a second right side moving bolster adapted to be moved into and out of said second press station;

a first motor mounted on said first left side moving bolster for driving the same;

a second motor mounted on said second left side moving bolster for driving the same;

a third motor mounted on said second right side moving bolster for driving the same;

a fourth motor mounted on said first right side moving bolster for driving the same;

a first controller mounted on said first left side moving bolster;

a second controller mounted on said second right side moving bolster;

a first cable reel mounted on said bed at a left end portion thereof;

a second cable reel mounted on said second left side moving bolster;

a third cable reel mounted on said bed at a right end portion thereof;

a fourth cable reel mounted on said first right side moving bolster;

a first cable winding round said first cable reel and having one end connected to a first power source and the other end connected to said first controller;

a second cable interconnecting said first controller and said first motor;

a third cable winding round said second cable reel and having one end connected to said first controller and the other end connected to said second motor;

a fourth cable winding round said third cable reel and having one end connected to a second power source and the other end connected to said second controller;

a fifth cable interconnecting said second controller and said third motor; and a sixth cable winding round said fourth cable reel and having one end connected to said second controller and the other end connected to said fourth motor.

* * * * *